United States Patent [19]

Vandergriff

[11] Patent Number: 5,016,320

[45] Date of Patent: May 21, 1991

[54] COTTON GIN FEEDER AND PREGINNER

[75] Inventor: Arvel L. Vandergriff, Visalia, Calif.

[73] Assignee: Consolidated HGM Corp., Lubbock, Tex.

[21] Appl. No.: 489,476

[22] Filed: Mar. 5, 1990

[51] Int. Cl.[5] ..... D01B 1/06

[52] U.S. Cl. ..... 19/40

[58] Field of Search ..... 19/40, 43, 48 R, 49, 19/50, 42, 44, 64.5

[56] References Cited

U.S. PATENT DOCUMENTS

| | | | |
|---|---|---|---|
| 655,167 | 9/1901 | Prior | 19/49 |
| 1,002,598 | 9/1911 | McNally | 19/49 |
| 1,900,154 | 3/1933 | Blanchard | 19/44 |
| 1,918,610 | 7/1933 | Mitchell | 19/48 R |
| 2,933,770 | 4/1960 | Jennings | 19/48 R |
| 3,320,640 | 5/1967 | Van Doorn | 19/64.5 |
| 3,495,303 | 2/1970 | Slover | 19/64.5 |
| 4,779,309 | 10/1988 | Van Doorn | 19/43 X |

FOREIGN PATENT DOCUMENTS

| | | | |
|---|---|---|---|
| 779455 | 11/1980 | U.S.S.R. | 19/40 |

*Primary Examiner*—Werner H. Schroeder
*Assistant Examiner*—John J. Calvert
*Attorney, Agent, or Firm*—Wendell Coffee

[57] ABSTRACT

The lint from the roller gin stand is divided into two streams and a small portion is recirculated through the feeding equipment so that the lint to seed ratio is increased at the roller gin. The pre-gin equipment acts to distribute and break up not only wads of cotton but also individual locks of cotton into smaller components called individual seed locks. Some seed will be completely separated from lint in this process. This process of preparation of the seed cotton for the ginning will actually partially pre-gin the cotton. It is accomplished by wiping the cotton by spiked rollers over concave segments some of which have projecting bars from them. The cotton is pulled or diverted over separation ridges which project between the rollers.

12 Claims, 3 Drawing Sheets

COTTON GIN FEEDER AND PREGINNER

CROSS REFERENCE TO RELATED APPLICATION

None, however, Applicant filed Disclosure Document Number 222067 on Mar. 13, 1989 which document concerns this application.

RIGHTS TO INVENTIONS UNDER FEDERAL RESEARCH

There was no federally sponsored research and development concerning this invention.

BACKGROUND OF THE INVENTION (1) Field of the Invention

This invention relates to cotton gins and more particularly to preparing seed cotton to be ginned and as one specific example to prepare seed cotton to be fed to a roller gin. Cotton gin operators and manufacturers are those having ordinary skill in the art.

(2) Description of the Related Art

Broadly speaking, cotton ginning relates to separating cotton seed from lint in seed cotton. However, a cotton gin system includes the cleaning and preparation of the seed cotton before the seed cotton is specifically fed to the cotton gin (sometimes called a cotton gin stand to indicate this particular piece of equipment in the entire system). It is at the cotton gin stand itself that the seed is separated from the lint and the seed diverted to one location for its particular use and the lint is diverted to another location for its particular use.

Cotton itself is normally divided into two major catagories. The fuzzy seed cotton or upland cotton and the black seed cotton or the long staple cotton sometimes called sea island cotton. The two catagories of cotton are often ginned by different type cotton gins: upland cotton being ginned by a saw gin; black seed cotton by a roller gin. Special equipment, called feeders, are used to feed the cotton to the cotton gin stand. In the case of saw gins, the feeder normally not only functions as a final cleaning process of the seed cotton but also is to feed the cotton in locks into the seed roll of the saw gin. In the case of roller gins, the feeder also may perform an additional function as to break down the locks of cotton into individual seed locks to apply them to the roller in this fashion. For example, see my prior patent U.S. Pat. No. 4,914,786 issued Apr. 10, 1990.

Those having ordinary skill in the art of roller gins understand that basically a roller gin includes a roller usually referred to as a rubber roller which has a knife or doctor blade adjacent to the periphery thereof and a rotor bar for pulling the seed from the doctor blade.

SUMMARY OF THE INVENTION (1) Progressive Contribution to the Art

I have found that a higher ratio of lint to seed, as the mix reaches the ginning point, results in more unginned fibers being pulled under the knife along with the ginned lint. By higher ratio is meant that the ratio of lint to seed fed to the roller gin is greater than the ratio of lint to seed in the seed cotton being ginned. This is because the fibers tend to pull each other into the pinch point between the knife and the ginning roller. If there are areas where there are no fibers moving under the knife, the next fibers approaching may slip over the pinch point and not be ginned. It is very important to keep a continuous flow of fibers to the pinch point.

After this discovery is made, there might be different methods and structure by which the ratio of lint to seed might be increased. For example, the lint might not all be doffed from the roller or lint might be applied directly to the roller at a point on the roller separate from where the seed cotton was being applied. However, the preferred embodiment is to recirculate some of the ginned lint from the cotton gin stand to the cleaning and feeding equipment so that the additional lint is mixed with the seed cotton and this mixture fed to the roller.

Recirculating a small percentage of the ginned lint and mixing it with the unginned seed cotton will result in a more continuous film of fibers reaching the ginning point. As I have described in previous U.S. Pat. Nos. 3,251,094, 4,094,043 and 4,153,976, it is necessary for the blade passings of the rotor bar to be such as to permit partially ginned seed which are being pushed away from the ginning point, with fibers still held by the pinch point, to be allowed to return to the pinch point in order to fully gin them. This situation is primarily the result of there not being enough fibers in the pinch point to pull all the fibers from the seed during its first pass. A higher ratio of lint to seed will improve this situation, resulting in a faster rate of lint removal.

One means of recirculating some of the ginned lint is to split the flow in the air line carrying the flow of lint from the ginning roller. This method of splitting the flow makes use of a "Y" in the line and as the material reaches the "Y" part of the flow goes into one leg and part into the other leg, the proportion going each way can be easily adjusted by well known methods. The flow into one leg can be conveyed into an air separating unit, preferably over the distributor which distributes the main flow of seed cotton to be ginned to the battery of gins. This distributor often is a screw conveyor. The gin feeding unit will mix the ginned lint with the seed cotton to be ginned and deliver it to the ginning point, where the action described above takes place.

The operation of roller gins can be improved if the seed cotton is specially prepared. As taught by my previous patent (noted above), it is desirable to separate the locks of cotton into individual seed locks. Separating black seed cotton into individual seed locks will sometimes separate the seed from the lint. This is a desirable result. This special preparation also benefits saw gins.

This application also includes a gin feeder having as its primary function to separate the cotton into single seed locks and pregin the lint from as many seed as possible. Such action relieves the load on the roller gin, since it only has to separate the ginned seed from the lint as opposed to having to gin the lint off the seed and make the lint-seed separation in one action. Such a feeder consists of a series of spiked cylinders or rollers spaced close together and may be arranged in two sections, one above the other.

The action starts when the cotton is fed onto the front cylinder of the first sections. The tip speed of the pins on the cylinder is in the range of 1500 to 2000 feet per minute. The cylinder rotation is such that the cotton is carried over the top of all the cylinder on its way to passing under the cylinders. The first two cylinders fluff and break up any wads which might tend to jam the close clearance provided by the scrolls around the next cylinder. These scrolls hold the cotton against the cylinder pins and follow the cylinder contour in between them, resulting in a tearing action as the cotton transfers from one cylinder to the next. This action is not intended to separate seed completely from the lint, since the mass is scrubbed over screens in the continuing action for separating foreign matter, and any completely ginned seed would be lost with the foreign matter. I have chosen to use this procedure of limiting the loss of seed in this first section of cylinders, however, a system of separating more seed with the foreign matter and separating them in a separate process, is an option some operators may desire.

As the cotton travels around the back cylinder between the scroll and the cylinder pins, further restrictions such as blades, pins, or bars projecting from the scrolls may be employed for further ginning action. As the cotton continues around the cylinders it is scrubbed over screening sections for foreign matter removal. The screen sections may have openings large enough to permit the loss of ginned seed, or the openings may be small enough to prevent the passage of seed. In this case, of course, less foreign matter would be removed.

The screening sections are curved upward to a separation ridge between the cylinders much more than normal. The ridge may extend up to about one third the diameter of the cylinder below the center of the cylinders. The transfer actions from one cylinder to the next cylinder over the separation ridge, pulls the cotton apart and continues the preginning. From the first section of the spiked cylinders the cotton is discharged on to the top of another series of cylinders.

As it travels over the top of these cylinders it is again confined between cylinder pins and scrolls, especially at the transfer between the cylinders, to continue the preginning. This action between the pins and the scrolls can be increased with projecting pins, blades or bars, as described above.

As the cotton passes under these cylinders, the cylinder pins drag it over scrolls with no holes. The previous action has been drastic enough to result in a significant amount of separated seed which would pass through the screens. It is a matter of choice whether the screen sections have no openings, openings small enough to preclude the loss of seed, or openings large enough to let seed pass and separate them from the foreign matter in a separate process.

The most significant feature of this section is the bars or blades projecting away from the separation ridge between the cylinders. The projection is adjustable and the normal setting is as described above. The top edge of the bar to a point some what less than ⅓ the diameter of the cylinder below the centerline of the cylinders. (8" to 10" diameter cylinders are common). The ginning action resulting from the transfer over these bars can be increased by reducing the thickness of the bars. I have found 1/32" to 1/16" thick edge is satisfactory. This repeated transfer over the edges of the bars strips the seed from the lint.

This action is desirable for ginning both fuzzy seed, (upland) cotton and black seed (long staple) cotton. In either case the more lint that can be removed from the seed before reaching the ginning point the greater the rate of ginning. With the black seed (long staple) cotton it is possible to completely remove the lint from a high percentage of the seed with the process described above. And with this mixture of lint and ginned seed reaching the ginning point (where the ginning roller contacts the stationary knife) the ginning rate far exceeds that of normal.

(2) Objects of this Invention

An object of this invention is to gin seed cotton.

Another object of this invention is to prepare seed cotton for feeding into the cotton gin stand.

Further objects are to achieve the above with devices that are sturdy, compact, durable, lightweight, simple, safe efficient, versatile, ecologically compatible, energy conserving, and reliable, yet inexpensive and easy to manufacture, connect, adjust, operate and maintain.

Other objects are to achieve the above with a method that is rapid, versatile, ecologically compatible, energy conserving, efficient, and inexpensive, and does not require highly skilled people to connect, adjust, operate, and maintain.

The specific nature of the invention, as well as other objects, uses, and advantages thereof, will clearly appear from the following description and from the accompanying drawing, the different views of which are not scale drawings.

Figure 1:
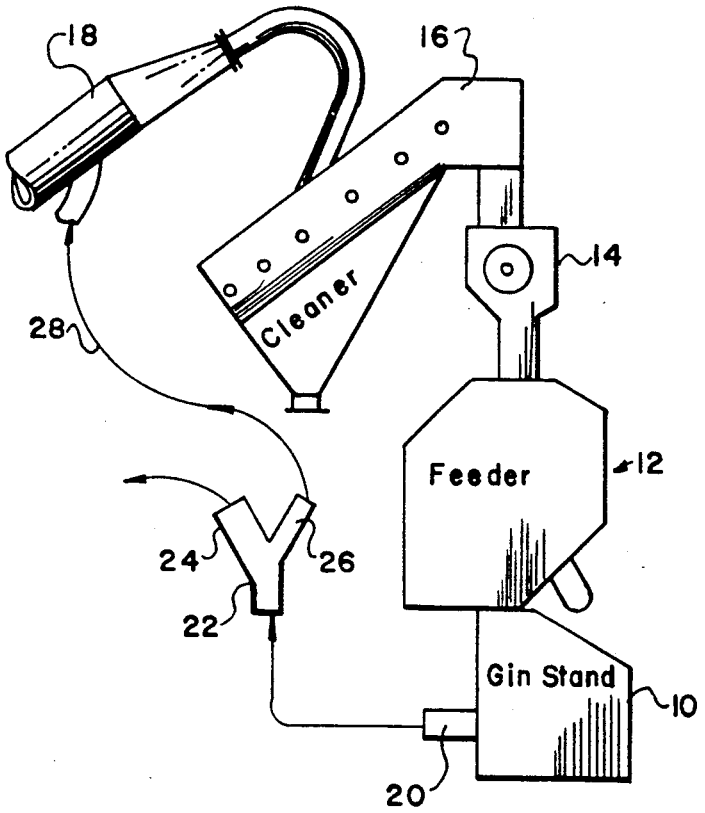
FIG. 1 is a schematic representation of a cotton ginning system according to this invention.

As an aid to correlating the terms of the claims to the exemplary drawing, the following catalog of elements is provided:

10 gin stand
12 feeder
14 distributor
16 cleaner
18 suction pipe
20 lint flue
56 cylindrical section
22 Y or lint divider
58 separation ridge
24 larger leg
60 lower separation ridges
26 smaller leg
62 lower cylindrical section
28 recirculating conduit
64 aprons
30 upper tier
66 auger
32 lower tier
68 bars
34 feed rollers
70 upper scroll
36 spiked roller One
71 lower roller One
38 roller One-A
72 lower roller One-A
40 roller Two
74 bottom scroll
42 roller Three
76 flange
44 power means
78 slot
46 spikes
80 bolt
48 scroll
82 projection portion 50 sides
84 twist brush
52 cylindrical segments
54 top scroll cylindrical segment

DESCRIPTION OF THE PREFERRED EMBODIMENTS

Referring to the drawings and more particularly to FIG. 1, there may be seen a schematic representation of a cotton gin system. Specifically included is gin stand 10 and feeder 12. It will be understood by those having skill in the art that a normal system would have a plurality of gin stands and each gin stand would have its own feeder. Distributor 14 distributes the cotton from cleaner 16 to the various feeders. Normally the cotton is brought to the cleaner 16 by an air stream within suction pipe 18.

Those having ordinary skill in the art will understand that the description of equipment to this point is common to almost all cotton gins whether they be roller gins or saw gins.

After the lint has been separated from the seed at the gin stand 10 normally the lint will be discharged from the gin in an airstream through lint flue 20. According to this invention, the flue will have a "Y" or lint divider 22 therein. The major part of the lint will follow larger leg 24 where the lint is further processed and baled as is well known. According to this invention the lint in smaller leg 26 is diverted by suitable recirculating conduit 28 to the main flow of seed cotton as illustrated in the drawing, within the suction pipe 18.

As discussed above, this accomplishes the purpose of recirculating ginned lint to the feeder equipment to be fed to the roller gin stand. Of course, the lint is also recirculated to cleaner equipment before the distributor but eventually it is obviously recirculated to the feeder equipment 12.

Recirculating the ginned lint accomplishes the purposes of increasing the ratio of lint to seed fed to the roller gin to more than the ratio of lint to seed in the seed cotton being ginned. The seed cotton to be ginned contained in the suction pipe 18, has a certain ratio of lint to seed.

It will be understood that the recirculating ginned lint is beneficial only to a roller gin. However, the preparation and preginning as described as follows in the feeder 12 is beneficial in both roller gins and saw gins operating either on black seed cotton or fuzzy seed upland cotton.

The feeder 12 has upper tier 30 and lower tier 32 of spiked rollers to prepare, pre-gin, and feed the cotton to the gin stand 10.

Seed cotton from distributor 14 is dropped by feed rollers (not shown) onto spiked roller One 36 of the upper tier 30.

The upper tier includes four spiked rollers preferably all of equal size and identical manufacture. Although as stated it is preferable to have four spiked rollers in the upper tier it is believed that a satisfactory operation can be obtained with only three rollers in either the upper tier 30 or the lower tier 32. The rollers are designated as roller One 36, roller One-A 38, roller Two 40 and roller Three 42. The axis of all of the rollers are parallel to each other. The rollers are mounted upon an incline and preferably the axis of the rollers are in the same inclined plane. Roller One 36 is the highest roller and it is higher than rollers One-A and Two. The roller Three 42 is the lowest roller.

Power means 44 including electric motors, belts, etc., are mounted onto the feeder 12 to rotate each of the rollers in the same direction, which as viewed in the drawing is counter-clockwise. I.e., the top of roller One turns toward roller One-A and toward roller Two. Likewise the bottom of roller Three turns toward roller Two and the bottom of roller Two also turns toward roller One-A and One.

Therefore seed cotton being fed by the feed rollers to the top of the roller One 36 will by the rotation, move to roller One-A 36 and subsequently to roller Two and roller Three. Because the rollers are on an incline the cotton from roller One will tend not to fall between the spaces between roller One and One-A. Both gravity and centrifugal force will tend to move the cotton to another roller as it moves along.

The rollers all have spikes 46. The rollers are spaced as close to the adjacent rollers as mechanically feasible. I.e., the clearance between the tips of the spikes would be as little as ¼". Mechanical problems are experienced if attempts are made to space the rollers closer together than ¼".

Scroll 48 is mounted to sides 50 of the feeder 12 to guide and confine the cotton to the rollers. The scroll is a series of adjacent cylindrical segments 52. The cylindrical segments are basically co-axial with the axis of the rollers they related to. Specifically the top scroll cylindrical segment 54 would extend at least partially over roller Two. It may be seen that the cylindrical segment thereof is co-axial with the axis of roller Two. Likewise the top portion of cylindrical section 56 extends above roller Three 42.

The segments are joined or separated by separation ridge 58 between the adjacent cylindrical sections. The separation ridge is nearer the plane containing the axis of rollers than in conventional seed cotton cleaning equipment. Specifically the separation ridge is within a distance "a" from a plane "p" containing the axis of adjacent rollers. Specifically the separation ridge 58 between the roller Two 40 and roller Three 42 is such that the distance "a" as shown in the drawing is less than ⅓ of the diameter of roller Two or roller Three. Stated otherwise, if the rollers are 9" in diameter "d", the distance "a" would be less than 3".

The seed cotton going through the feeder 12 is wiped by the rollers along the concave surface of the adjacent cylinder segments. The cotton is confined to one roller until the cotton reaches the separation ridge. At that point the cotton is diverted, or deviated, or deflected, or turned. I.e. as the cotton is wiped along one of the segments by roller Two until it reaches the separation ridge 58 it is following the circular path as it is confined by the cylindrical segment and by the spiked roller. However, at the separation ridge, because of gravity and centrifugal force, it will tend to move toward roller Three. It will be understood that until the separation ridge is reached, it is prevented from moving toward roller Three because of the scroll. At that point the cotton is diverted, deviated, turned, deflected, by roller Three up along what was before the adjacent cylindrical segment. This diverging the cotton over the separation ridge, causes the cotton to be separated and will often pull the lint of the seed cotton away from the seed, i.e., the lint is freed from the seed. This is particularly true with black seed cotton where the lint is not as securely attached to the seed as in the case of fuzzy seed cotton. It will be understood that the lint and seed still move along the same path and are still intermingled, however they are no longer fixed together. As described above, this is desirable and this is the purpose I seek to accomplish with my particular feeder 12. If the cotton lint is not freed from the seed there will first be a separation of clumps and wads of cotton in individual locks. Furthermore, there will be a separation of the locks into individual seed locks. A seed lock being one cotton seed with the lint attached thereto.

To increase this disruption of the seed cotton I have found it desirable to place projections upon the concave surfaces of the cylindrical segments 52. A form of such projection is a ¼ inch or flat square bar 59 which extends parallel to the axis of the rollers Two 40 and rollers Three 42. It is particularly desired that they be placed along the upper cylindrical segments 54 inasmuch as trash will not build up around them, the trash and the like falling from them by gravity back to the rollers below them.

The cylindrical segment of the scroll 48 around roller Three 42 extends around the roller to also extend below the roller. The scroll with adjacent cylindrical segments also extends below roller Three 42, roller Two 40, roller One-A 38 and a portion of roller One 36.

Lower separation ridges 60 which are below the rollers likewise extend away from the cylindrical segments and toward a plane containing the axis of adjacent rollers so that the distance from the separation ridge to the plane containing adjacent rollers is less than ⅓ the diameter of the adjacent rollers. Although a substantial amount of the preparation of seed cotton will occur over the two separation rollers that are over the top of the rollers, the preparation will continue along the bottom of the rollers.

The lower separation ridges 60 between the lower cylindrical section 62 may be in the form of a screen. As discussed above it is desired, at least for the upper tier of rollers 30, that these lower segments be a screen to remove trash. Generally I prefer these screens be small enough so that no seed is lost at this point but only trash (such as dust or leaf trash) is removed. The trash which is separated at this point is discharged upon aprons 64 where it falls by gravity into a discharge conveyor such as auger 66 for disposal.

The seed cotton, after having been processed by the upper tier is discharged therefrom and subsequently falls upon roller One 71 or One-A 72 of the lower tier 32. The lower tier also contains four rollers as described above which are also parallel, of equal size and inclined and similar to the rollers of upper tier 30.

Although the rollers are the same as the upper tier, the scroll may be different and preferably are. Specifically on upper scroll 70 it is desirable to have blades or bars 68 depend from the top of upper scroll 70 of the lower tier 32. These bars 68 would project from the separation ridge 58 normal to the plane connecting the axis of adjacent rollers. The bars would extend the full length of the rollers and preferably would be made of steel plate of about 3/16" of thickness. The distance that the bars would project from the separation ridge would be adjustable. I have found that the bars perform better if the exposed edges of the bars are reduced to about 1/16" thickness. It is desired that they be prepared so that there is a square edge. I.e., the edges are not rounded. However, it will be obvious that in a short period of time in operation that the seed cotton being diverted over the edge of the bar will cause the sharp edges to round off.

The edges of the bars 68 are adjusted as close as operable to the plane containing the axis of adjacent rollers. In operation it has been found that the limit is about ⅛ of an inch projecting away from the separation ridge. If they are extended closer to the axial plane, the cotton tends to follow the roller around the roller rather than being diverted across the edge of the bar 68 onto the subsequent roller. Obviously the purpose is to cause the seed cotton to divert across the bar and not to follow the original roller around. Therefore it is found that the bars work better from the top scroll because in such a case is that the gravity tends to transfer the cotton to the subsequent roller more than it does on bottom scroll 74. The bottom scroll 74 being the scroll below the rollers.

Inasmuch as a majority of the trash has been cleaned from the seed cotton before the cotton arrives at the lower tier 32 it is not necessary to have a screen below the rollers. I.e., the scroll 74 below the rollers would not be perforated to form a screen. However, certain operators may prefer that there be a screen below the lower tier and that this screen have openings sufficiently large that the cotton seed will fall through the opening. I.e., in this case not only would the feeder free the lint from the seed but would also separate the seed from the lint.

From the bottom of roller One 71 of the lower tier the cotton is fed to the gin stand as is known in the art.

It is also desirable to have the separation bars 68 extend upward from the separation ridges 58 from bottom scroll 74 of the lower tier 32.

Figure 5:
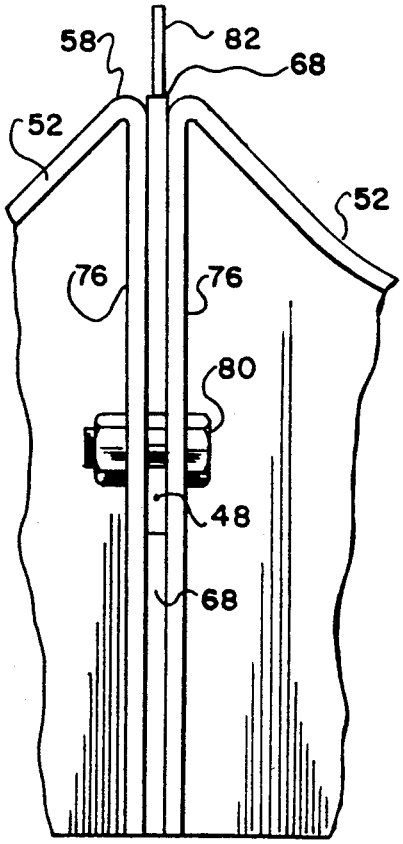
FIG. 5 is a detail of a bar extending away from a separation ridge.
Figure 2:
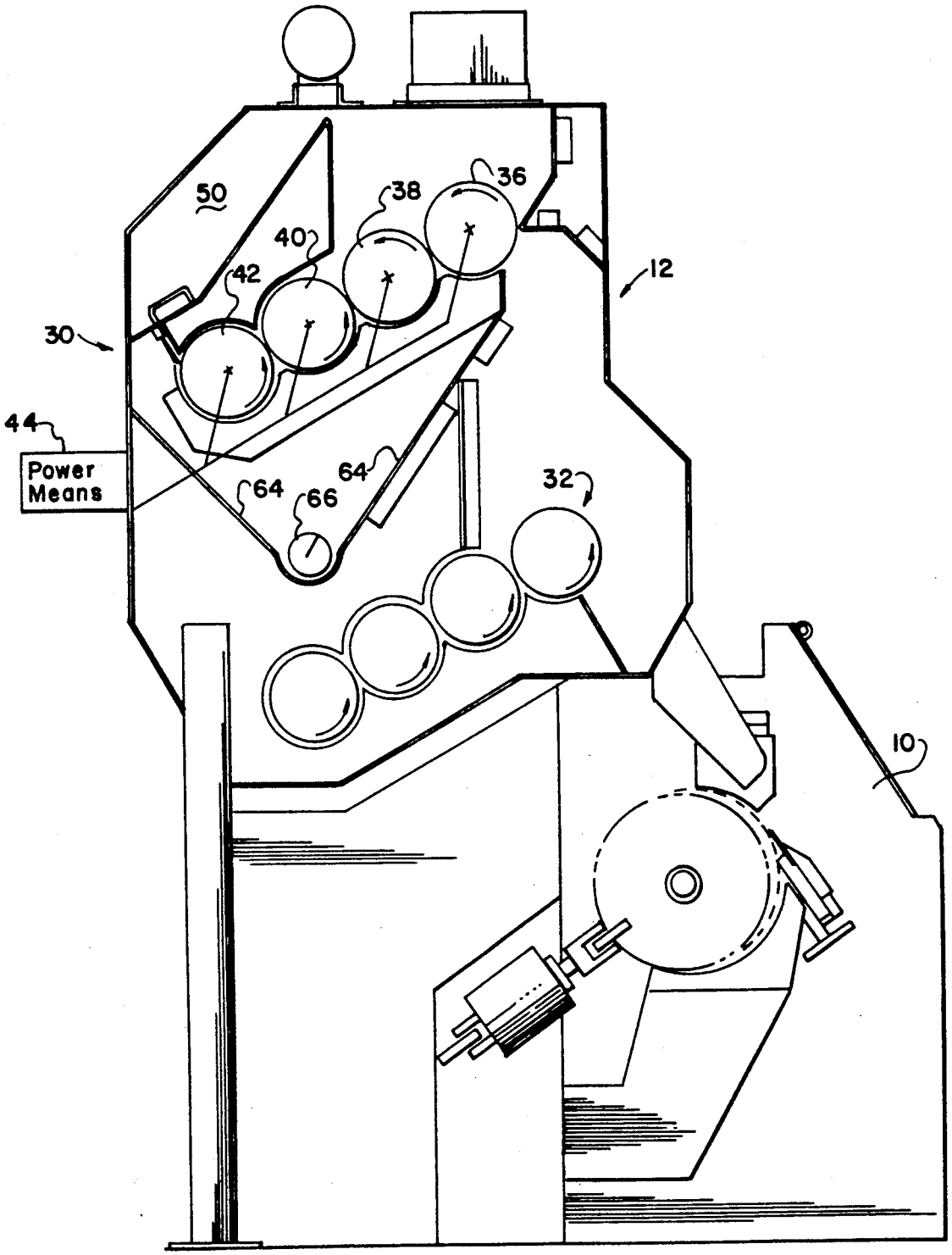
FIG. 2 is a side sectional view of a feeder and roller gin stand with parts ommitted for clarity.

A detail of the detachment of the bars 68 is seen in FIG. 5. It will be understood that the cylindrical segments 52 will have a lower flange 76 upon each side thereof. These two flanges 76 will be separated by about 3/16", the width of the separation bar 68. The separation bar will have slot 78 therethrough. Bolt 80 holds the separation bar in place. It is clearly seen in FIG. 8 the separation bar has the projection portion 82 which is the part that actually projects beyond the separation ridge 58. This projection portion 82 of the bar 68 will be the part that is thinned to a thickness of about 1/16".

Figures 3, 4:
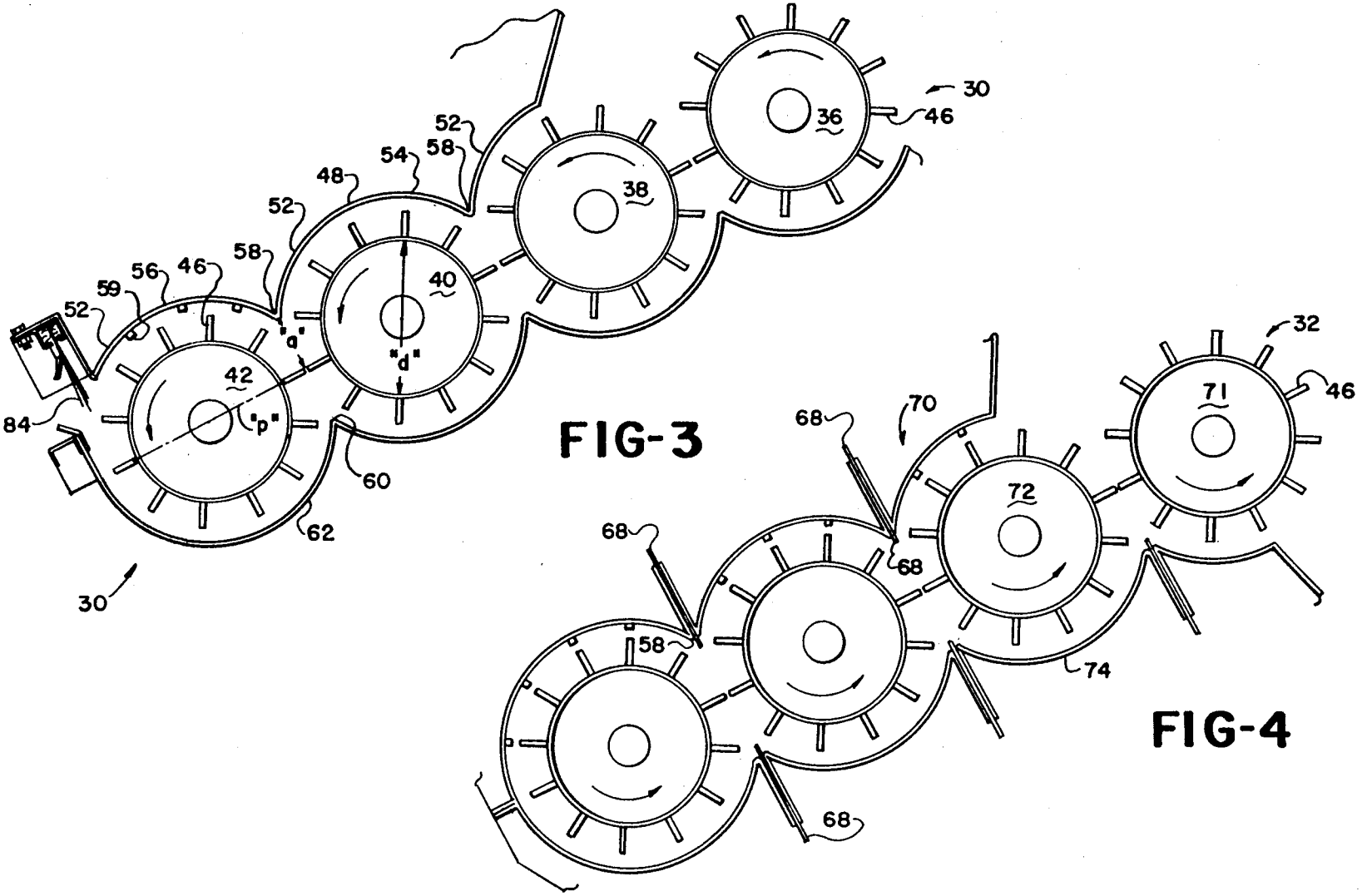
FIG. 3 is a cross-sectional view of the upper tier of preparation rollers.
FIG. 4 is a cross-sectional view of the bottom tier of preparation rollers.

Also the harvesting of the cotton by a spindle harvester sometimes causes the cotton to twist. A spindle twist brush 84 mounted as shown in FIG. 3 will straighten most of the twisted cotton.

The embodiment shown and described above is only exemplary. I do not claim to have invented all the parts, elements or steps described. Various modifications can be made in the construction, material, arrangement, and operation, and still be within the scope of my invention.

The restrictive description and drawing of the specific example above do not point out what an infringement of this patent would be, but are to enable one skilled in the art to make and use the invention. The limits of the invention and the bounds of the patent protection are measured by and defined in the following claims.

I claim as my invention:

1. The process involving a roller cotton gin wherein the improved method comprises increasing, the ratio of lint to seed fed on the roller gin to more than the initial ratio of lint to seed in the seed cotton being ginned.

2. The process as defined in claim 1 including a roller cotton gin system having:

a. at least one roller gin stand, and b. feeder equipment adapted to feeding seed cotton to the roller gin stand;

wherein the improved method further comprising:

c. recirculating ginned lint cotton to the feeder equipment to be fed to the roller gin stand.

3. The process involving a cotton gin system having a. at least one gin stand, and b. feeder equipment adapted to feed seed cotton to the gin stand; wherein the improved method of preparing the seed cotton to be fed to the gin stand comprises:

c. wiping the seed cotton along concave surfaces of cylindrical segments of a scroll by adjacent rotating spiked rollers each having an axis, and d. diverting the seed cotton over a separation ridge between said adjacent segments, e. said separation ridge being a distance from a plane containing the axes of the adjacent rollers which is less than one third the diameter of one of said adjacent rollers.

4. The invention as defined in claim 3 wherein the cotton ginning system is a roller cotton gin and further comprising:

f. increasing the ratio of lint to seed fed on the roller gin to more than the ratio of lint to seed in the seed cotton being ginned.

5. The invention as defined in claim 4 wherein the improved method is accomplished by recirculating ginned lint cotton to the feeder equipment to be fed to the roller gin stand.

6. The invention as defined in claim 3 further comprising:

f. projecting bars away from said separation ridge between the cylindrical segments.

7. The invention as defined in claim 3 further comprising:

f. disrupting the seed cotton along the concave surfaces of adjacent cylindrical segments by, i. placing projections along the concave surfaces, whereby ii. the seed cotton is broken up, and the individual seed locks are separated within locks of cotton.

8. In a cotton gin system having, at least one gin stand; the improved feeder equipment for feeding seed cotton to the gin stand comprising:

a. at least three horizontal spiked rollers designated as roller One, roller Two, and roller Three, each having an axis parallel to the axes of each other roller, b. the roller One is higher than roller Two which is higher than roller Three, c. power means attached to each roller for rotating each roller in the same direction so that the top of roller One turns toward roller Two, d. a top scroll above at least part of roller Two and above roller Three, e. said top scroll including concave surfaces of adjacent cylindrical segments one each of said segments over one each of said roller, and f. a separation ridge between said adjacent segments, g. said separation ridge being a distance from a plane containing the axes of the adjacent rollers which is less than one third the diameter of one of said adjacent rollers.

9. The invention as defined in claim 8 further comprising:

h. a bar projecting away from the separation ridge toward said plane containing the axes of adjacent rollers.

10. The invention as defined in claim 8 further comprising:

h. projections in the form of metal bars on at least some of said concave surfaces, i. said projections parallel to said roller axes.

11. The invention as defined in claim 10 further comprising:

j. a bar projecting away from the separation ridge toward said plane containing the axes of adjacent rollers.

12. The invention as defined in claim 8 further comprising:

h. at least some of said concave surfaces being perforated thereby forming screens.

* * * * *